US005465077A

United States Patent [19]

Kinoshita et al.

[11] Patent Number: 5,465,077

[45] Date of Patent: Nov. 7, 1995

[54] RELAY MODULE

[75] Inventors: Yasunori Kinoshita, Kunitachi; Shinichi Fujimori; Keiko Kobayashi, both of Minamitsuru, all of Japan

[73] Assignee: Fanuc Ltd., Yamanashi, Japan

[21] Appl. No.: 244,275

[22] PCT Filed: Sep. 29, 1993

[86] PCT No.: PCT/JP93/01400

§ 371 Date: May 23, 1994

§ 102(e) Date: May 23, 1994

[87] PCT Pub. No.: WO94/08374

PCT Pub. Date: Apr. 14, 1994

[30] Foreign Application Priority Data

Oct. 7, 1992 [JP] Japan ..... 4-268533

[51] Int. Cl.[6] ..... H01H 9/02

[52] U.S. Cl. ..... 335/132; 335/202

[58] Field of Search ..... 335/132, 202, 335/78–86, 128; 361/611, 624, 614, 636, 837

[56] References Cited

U.S. PATENT DOCUMENTS 2,897,410 7/1959 Hammerly ..... 361/314

5,231,365 7/1993 Kato ..... 335/132

FOREIGN PATENT DOCUMENTS 53-83641 7/1978 Japan .

*Primary Examiner*—Lincoln Donovan

*Attorney, Agent, or Firm*—Staas & Halsey

[57] ABSTRACT

A relay module, by which a time required when a motor is optionally mounted on a machine tool or removed therefrom can be omitted. The relay module comprises only a case and terminal screws of an electromagnetic contactor for a motor from which internal components are removed. The relay module is disposed when the motor is not connected and an electromagnetic switch is disposed when the motor is connected. Further, the relay module or electromagnetic switch is wired at all times. When the motor is optionally mounted on the machine tool, it suffices only to replace the relay module thereof with the electromagnetic switch and no wiring job is additionally required. Further, when the motor is removed, it suffices only to replace the electromagnetic switch with the relay module and a job for removing the wiring is not necessary.

4 Claims, 6 Drawing Sheets

RELAY MODULE

BACKGROUND OF THE INVENTION

1. Technical Field

The present invention relates to a relay module for relaying the wiring of a motor circuit, and more specifically, to a relay module used in place of an electromagnetic switch used when an induction motor is connected.

2. Description of the Related Art

When an induction motor is to be additionally connected to a machine tool, an electromagnetic switch must be mounted on the distribution panel of the machine tool and the induction motor must be connected to the machine tool through a wiring additionally connected to the electromagnetic switch. Alternatively, as described below, when the electromagnetic switch is mounted between two terminal bases previously provided for the distribution panel, wirings are additionally connected between the two terminal bases and the electromagnetic switch to connect the induction motor. The connection of the induction motor will be described with reference to FIG. 6.

FIGS. 6(A) and 6(B) are diagrams explaining the induction motor connected by the above conventional method, wherein FIG. 6 (A) shows the state that the induction motor is not connected and FIG. 6 (B) shows the state that the induction motor is connected, respectively. In FIG. 6 (A), a distribution panel 20 is connected to, for example, an I/O circuit of a programmable machine controller (PMC) of a numerically controlled machine tool. The distribution panel 20 has two rows of terminal bases 21 and 22 spaced apart from each other. When an induction motor 30 is to be connected to the distribution panel 20, an electromagnetic switch 100 must be disposed between the terminal bases 21 and 22 to turn ON/OFF power supplied to the induction motor 30, as shown in FIG. 6 (B). Therefore, the respective terminals 21*a*, 21*b*, 21*c* of the terminal base 21 must be connected to the primary terminals 100*a*, 100*b*, 100*c* of the electromagnetic switch 100 through additional wires and the secondary terminals 100*d*, 100*e*, 100*f* of the electromagnetic switch 100 must be connected to the respective terminals 22*a*, 22*b*, 22*c* of the terminal base 22 through additional wires.

Nevertheless, since this induction motor 30 is optionally provided for the machine tool, whether it is to be mounted or not is often altered even in the time from the placement of an order from a user to the shipment of the machine tool. Moreover, several tens of the induction motor 30 may be used in a single machine tool. Consequently, a problem arises in that a job for mounting or dismounting the induction motor 30 is increased even during a time until a single machine tool is shipped and each time the motor is mounted or dismounted, a job must be carried out to mount and wire the above electromagnetic switch 100 or dismount it and remove its wiring.

Note, since the electromagnetic switch 100 is expensive, when the induction motor 30 is to be removed, the electromagnetic switch 100 and the wiring thereof are removed accordingly and restored to the state shown in FIG. 6 (A).

As described above, it is very time-consuming to ship a single machine tool. Further, when a user actually uses the machine tool shipped thereto, he may mount or dismount the induction motor 30, and in this case a similar job must be carried out and this job is time-consuming in the same way.

SUMMARY OF THE INVENTION

Taking the above into consideration, an object of the present invention is to provide a relay module by which a time required when a motor is optionally mounted on a machine tool or removed therefrom can be omitted.

To solve the above problem, according to the present invention, there is provided a relay module for relaying the wiring of a motor circuit, which comprises only a case and terminal screws of an electromagnetic contactor for a motor from which internal components are removed.

The relay module for relaying the wiring of the motor circuit comprises only the case and terminal screws of the electromagnetic contactor for the motor from which the internal components are removed. The relay module is disposed when the motor is not connected and an electromagnetic switch is disposed when the motor is connected. Further, the relay module or electromagnetic switch is wired at all times. When the motor is optionally mounted on the machine tool, it suffices only to replace the relay module with the electromagnetic switch and no additional wiring job is required. Further, when the motor is removed from the machine tool, it suffices only to replace the electromagnetic switch with the relay module and the wiring need not be removed.

BRIEF DESCRIPTION OF THE DRAWINGS

FIGS. 6 (A) and 6(B) are diagrams explaining an induction motor connected by a conventional method, wherein

DETAILED DESCRIPTION OF THE PREFERRED EMBODIMENTS

An embodiment of the present invention will be described below with reference to the drawings.

An arrangement of a relay module of the present invention will be described with reference to FIG. 1 through FIG. 4.

Figure 1:
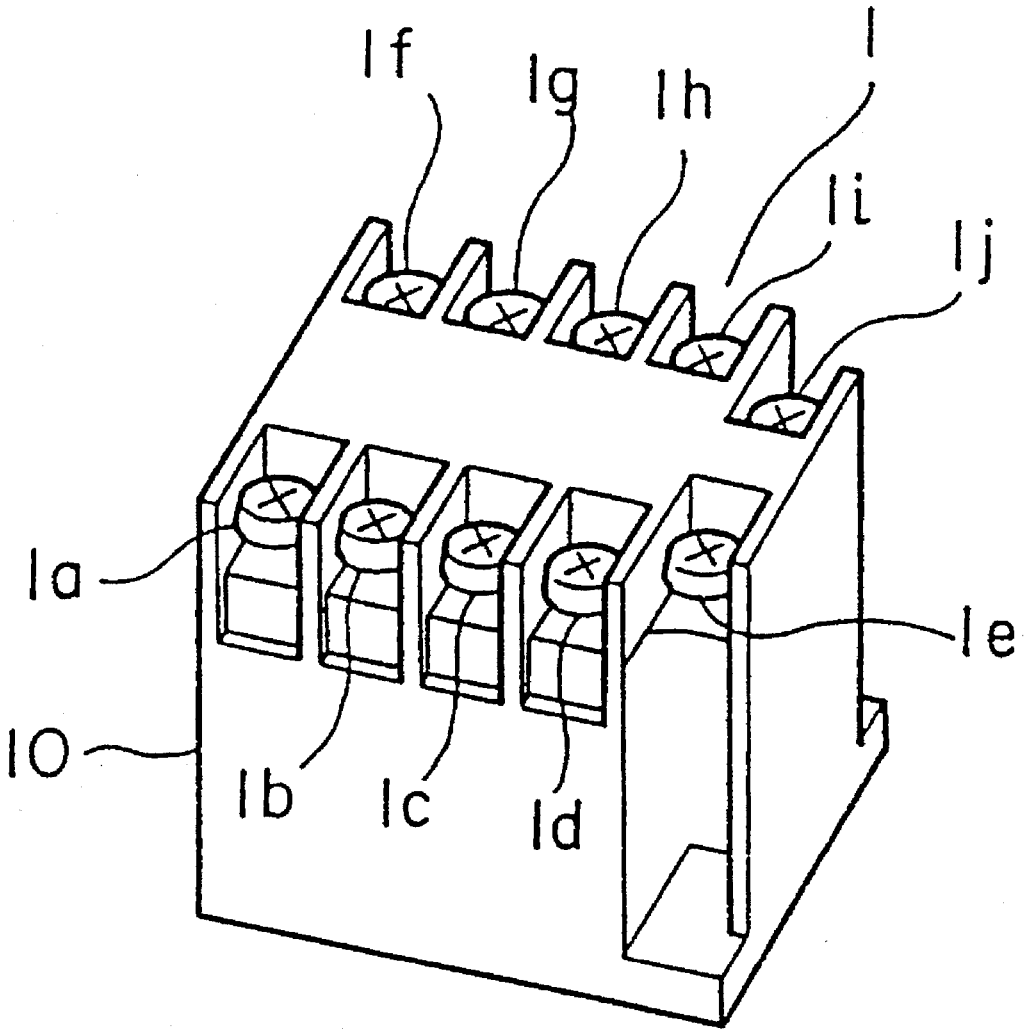
FIG. 1 is an outside view of a relay module of the present invention.
Figure 2:
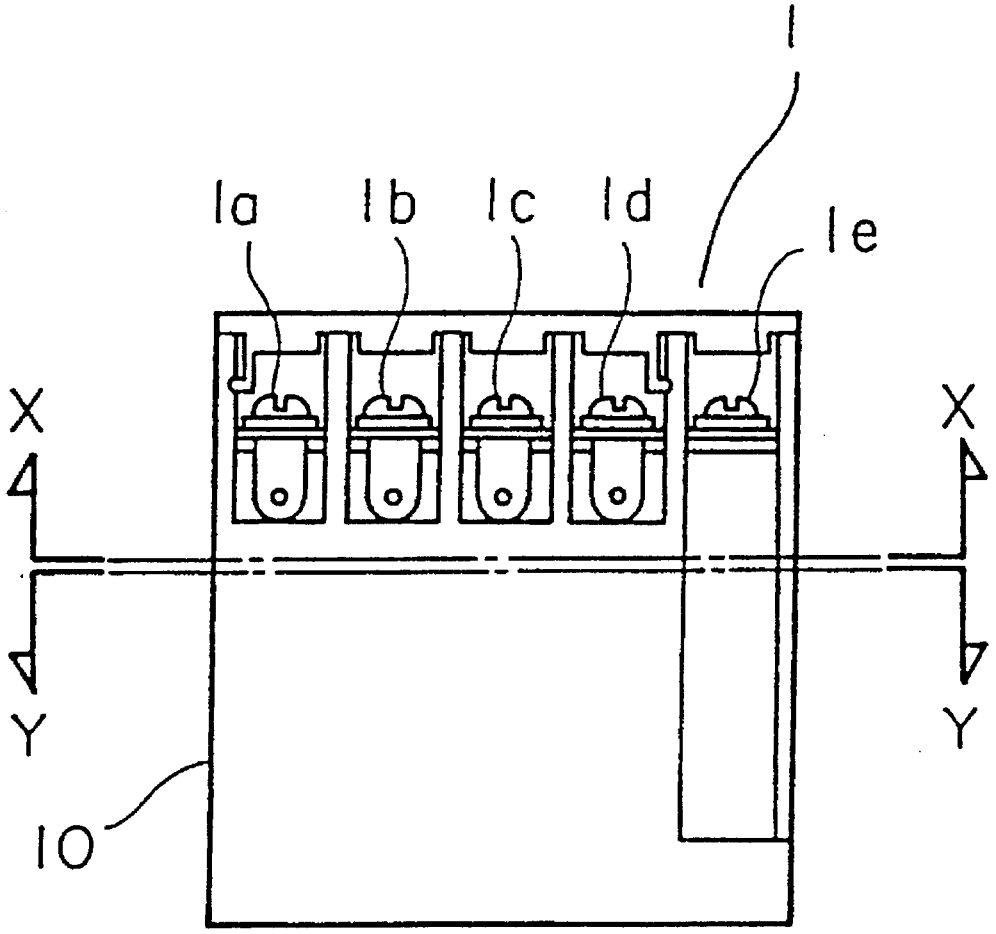
FIG. 2 is a side view of the relay module of the present invention.

FIG. 1 is an outside view of the relay module of the present invention and FIG. 2 is a side view thereof. In FIGS. 1 and 2, the relay module 1 is composed of a case 10 and terminals (terminal screws) 1*a*, 1*b*, 1*c*, 1*d*, 1*e*, 1*f*, 1*h*, 1*i* and 1*j*. The relay module 1 has an outside view similar to that of an electromagnetic contactor (a type of an electromagnetic switch from which thermal relays are removed) provided to turn ON/OFF the power supply of an induction motor. Note, as described below, although this relay module 1 is replaced with the electromagnetic switch when the induction motor is connected, at this time the terminals 1*a*, 1*b*, 1*c*, 1*d* correspond to the primary terminals of the electromagnetic switch and the terminals 1*f*, 1*g*, 1*h*, 1*i* correspond to the secondary terminals thereof. Further, the terminals 1*e* and 1*j* correspond to the terminals of the electromagnetic switch to which an operating voltage of 24 V is applied.

Figure 3:
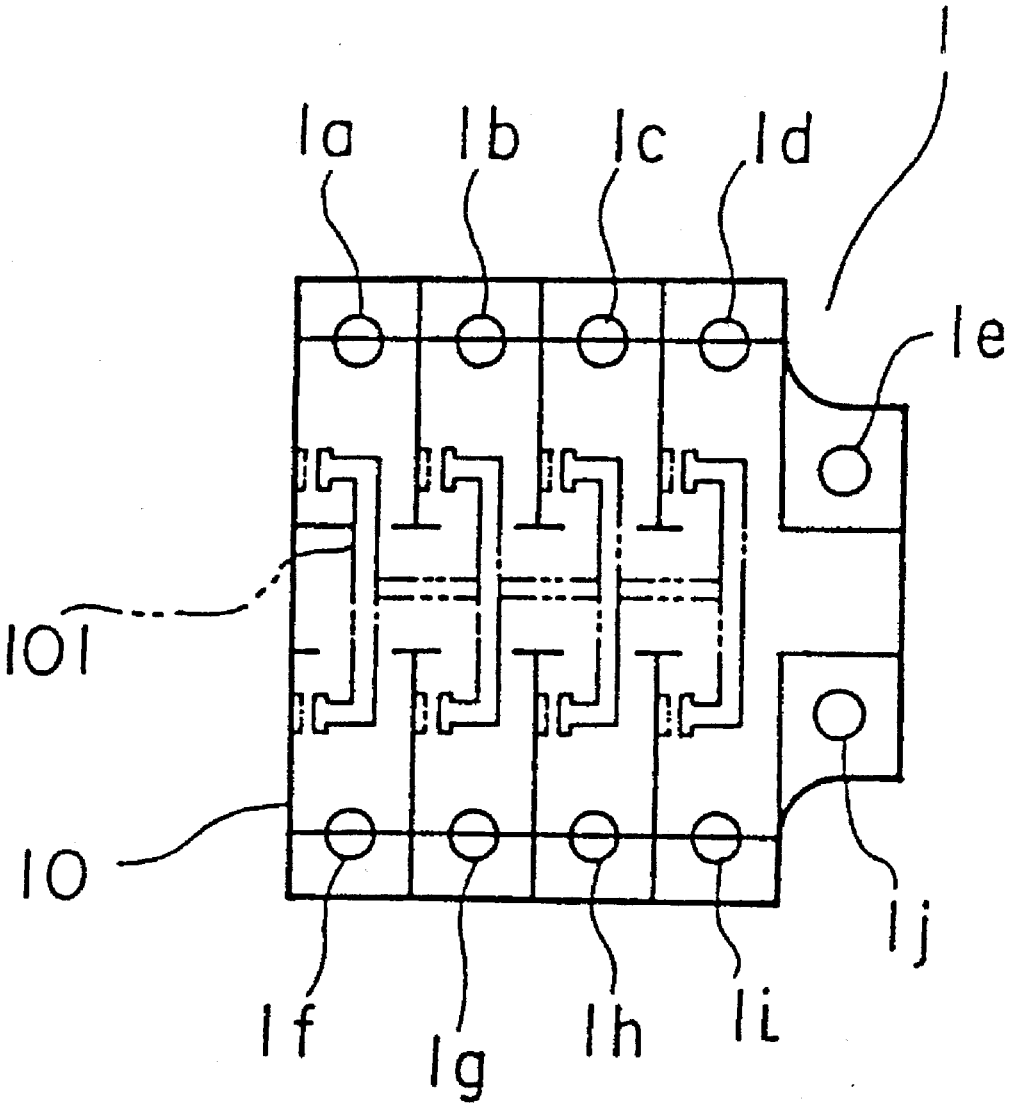
FIG. 3 is a cross sectional view of the relay module taken along the line X—X of FIG. 2.

FIG. 3 is a cross sectional view of the relay module 1 taken along the line X—X of FIG. 2. As shown in the FIG. 3, only the terminals 1*a* through 1*j* are disposed to the back surface on the terminal side of the case 10 of the relay module 1 and a contact portion 101 as a component of the electromagnetic contactor is removed therefrom.

Figure 4:
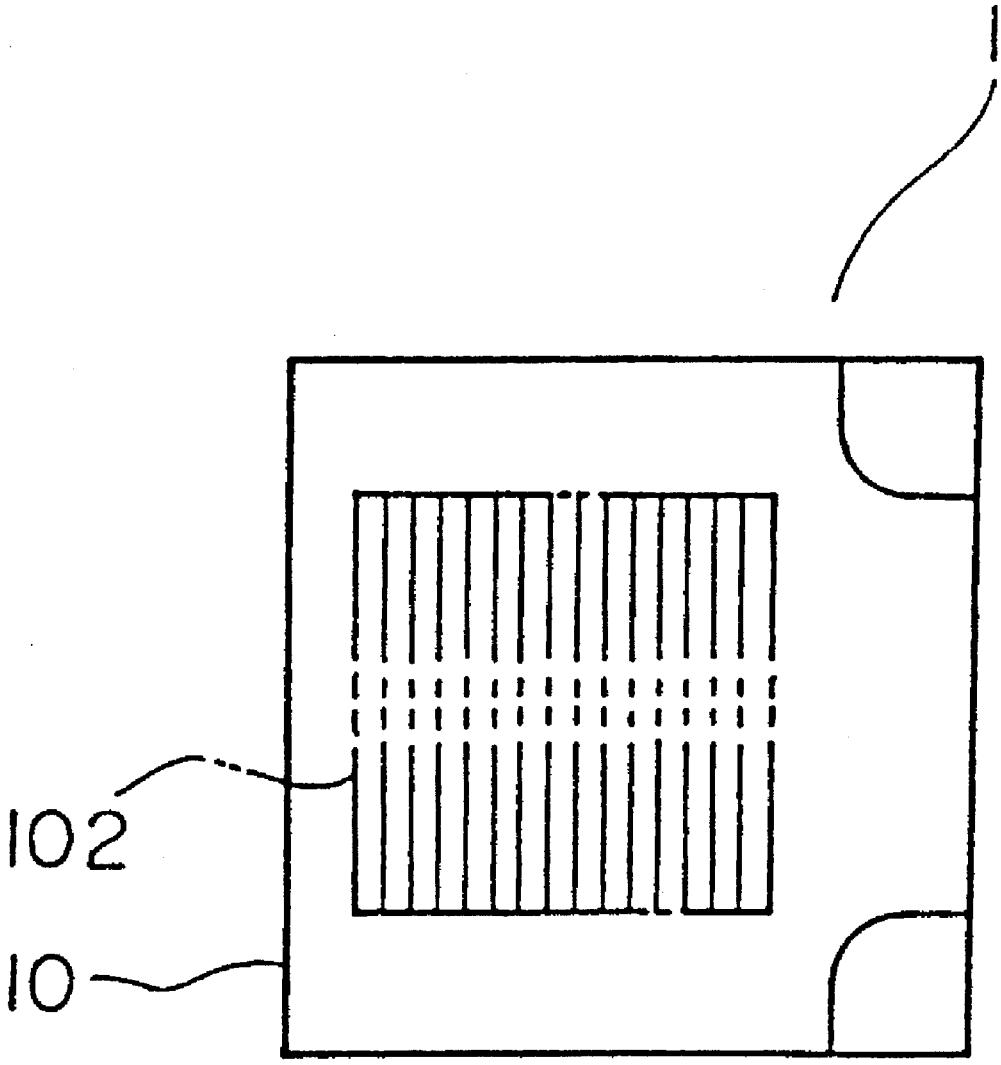
FIG. 4 is a cross sectional view of the relay module taken along the line Y—Y of FIG. 2.

FIG. 4 is a cross sectional view of the relay module 1 taken along the line Y—Y of FIG. 2. As shown in the FIG. 4, a cavity is formed to the bottom side of the case 10 of the relay module 1 and a coil 102 as a component of the electromagnetic contactor is removed therefrom. More specifically, the relay module 1 is arranged such that the internal components of the electromagnetic contactor are removed and the case 10 and the terminals 1*a* through 1*j* are included therein, as described above.

Next, an arrangement of the relay module 1 when it is mounted on a distribution panel will be described.

Figure 5:
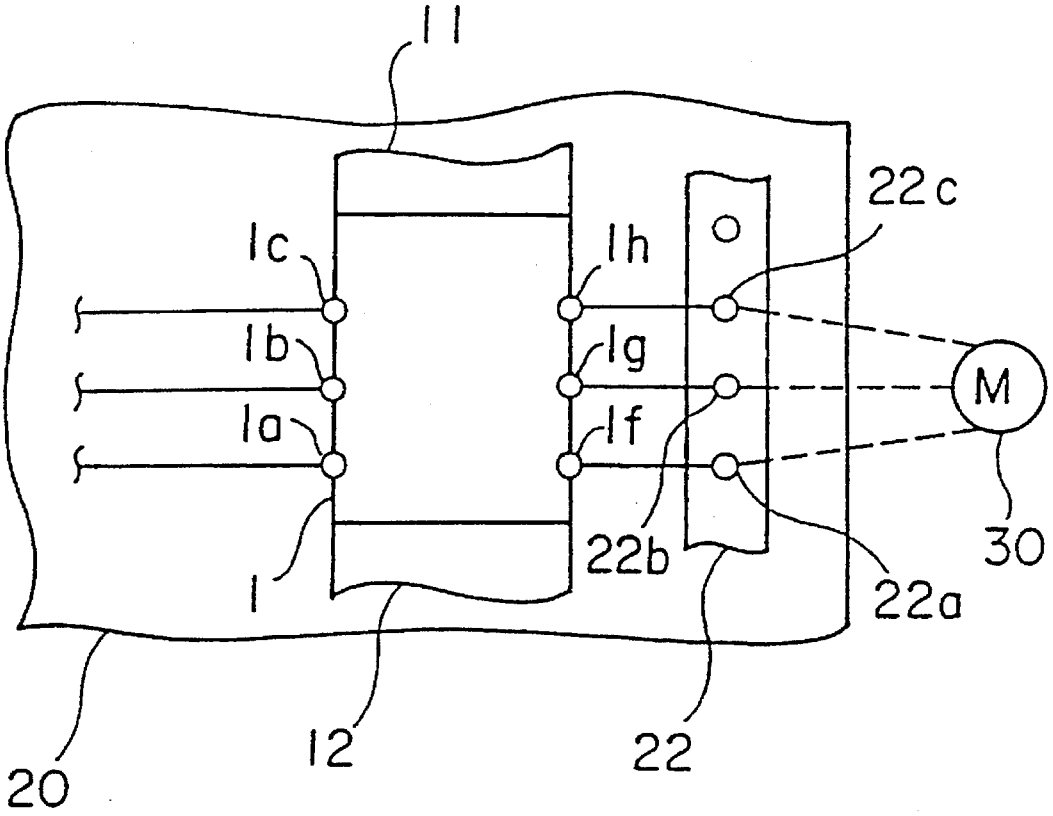
FIG. 5 is a diagram showing an arrangement of the relay module when it is mounted on a distribution panel.
Figure 6A:
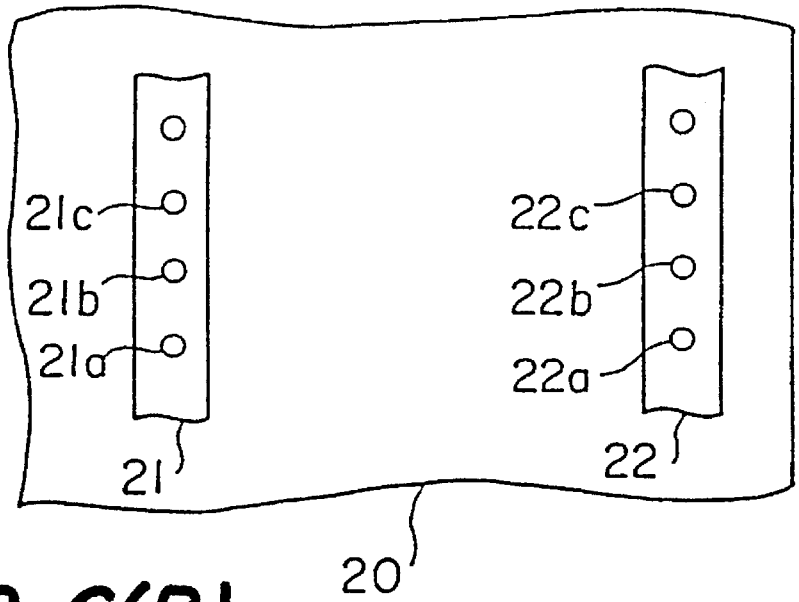
FIG. 6(A) PRIOR ART
FIG. 6(A) shows the state that the induction motor is not connected and FIG. 6(B) shows the state that the induction motor is connected, respectively.
Figure 6B:
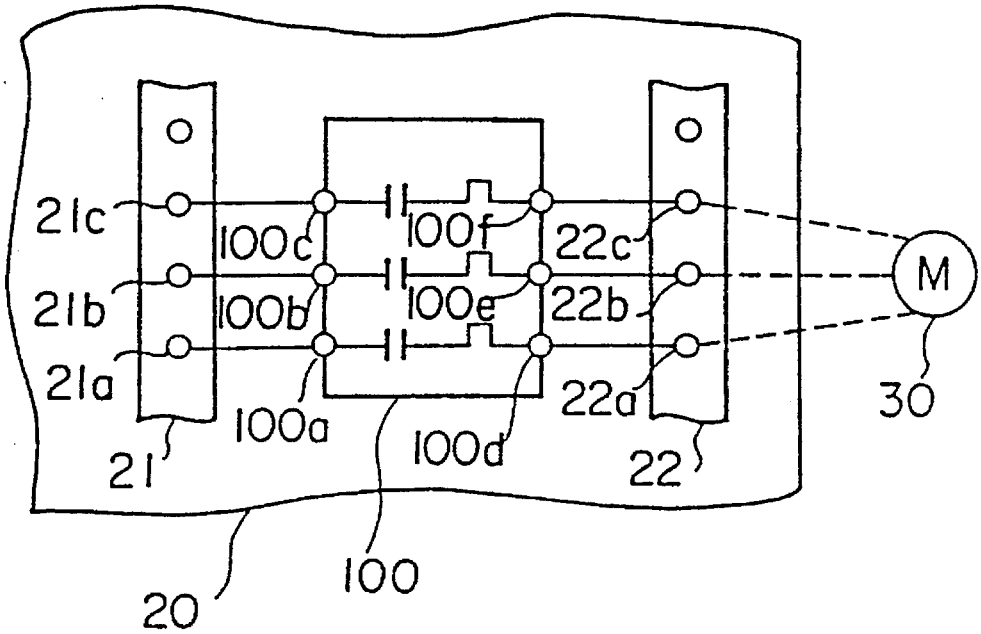
FIG. 6(B) PRIOR ART

FIG. 5 is a diagram showing the arrangement of the relay module when it is mounted on a distribution panel 20. As shown in the FIG. 5, the relay module 1 is used in the state that it is mounted on the distribution panel 20. Here, the distribution panel 20 is connected to, for example, an I/O circuit of the programmable machine controller (PMC) of a numerically controlled machine tool and previously provided with a terminal base 22. As many relay modules 1, 11, 12 and the like as necessary are continuously disposed on the left side of the terminal base 22 in the figure. More specifically, the terminals 1*f*, 1*g*, 1*h* of the relay module 1 are connected to the terminals 22*a*, 22*b*, 22*c* of the terminal base 22 and the respective terminals of the other relay modules 11 and the like are connected to the respective terminals of the terminal base 22 corresponding thereto.

Note, the distribution panel 20 has rails not shown disposed to the position corresponding to the relay module 1 and the like and the relay module 1 and the like are disposed along the terminal base 22 by being simply engaged with the rails.

When the induction motor 30 is to be optionally connected to the distribution panel 20 having the relay module 1 and the like disposed thereto, the electromagnetic switch must be provided for the distribution panel 20. In this case, however, it suffices only to replace the relay module 1 with the electromagnetic switch. Since the relay module 1 is previously provided with a wiring needed by the electromagnetic switch, even if it is replaced with the electromagnetic switch, no wiring job is additionally required and only a terminal connection job is necessary. Consequently, a time required to connect the induction motor 30 is omitted. Thus a working time can be greatly reduced as well as reducing cost.

The aforesaid can be similarly applied to the case in which the induction motor 30 already mounted on the distribution panel 20 is to be removed therefrom due to the change of a specification and the like. In this case, it suffices only to replace the electromagnetic switch with the relay module 1 and no wiring job is not additionally required and only a terminal connection job is necessary in the same way.

Further, since the relay modules 1, 11 and the like are mounted when the induction motor 30 is not mounted, they may be used in place of a primary terminal base which is conventionally mounted in parallel with the terminal base 22. More specifically, the conventionally required primary terminal base is not necessary and the space of the distribution panel 20 can effectively used accordingly.

As described above, according to the present invention, the relay module for relaying the wiring of a motor circuit is composed of only the case and terminal screws of the electromagnetic contactor for a motor from which the internal components are removed. The relay module is disposed when the motor is not connected and the electromagnetic switch is disposed when the motor is connected. Further, the relay module or electromagnetic switch is wired at all times.

As a result, when a motor is optionally mounted on a machine tool, it suffices only to replace the relay module with the electromagnetic switch and no wiring job is required. Further, when the motor is removed on the contrary, it suffices only to replace the electromagnetic switch with the relay module and the wiring need not be removed. Therefore, a time required to connect the motor is omitted, thus a working time can be greatly reduced as well as cost can be also reduced.

Further, a primary terminal base provided for a distribution panel is not necessary and the space of the distribution panel can effectively be used accordingly.

We claim:

1. A connection device for a numerically controlled machine tool, comprising:

a distribution panel of said numerically controlled machine tool;

an induction motor;

a relay module, including only a case and a plurality of terminal screws for an electromagnetic contactor for said induction motor, mounted on said distribution panel; and an electromagnetic switch which replaces said relay module to connect said induction motor to said distribution panel and to control a power supply to said induction motor.

2. A connection device according to claim 1, wherein contactors and electromagnetic driving contactors are removed from said electromagnetic contactor.

3. A connecting method for a numerically controlled machine tool, comprising the steps of:

providing a relay module including only a case and a plurality of terminal screws of an electromagnetic contactor;

mounting said relay module on a distribution panel of said numerically controlled machine tool; and replacing said relay module with an electromagnetic switch to connect said distribution panel to an induction motor and to control a power supply to said induction motor.

4. A disconnecting method for a numerically controlled machine tool, comprising the steps of:

connecting an electromagnetic switch to an induction motor and a distribution panel of said numerically controlled machine tool;

providing a relay module including only a case and a plurality of terminal screws of an electromagnetic contactor for said induction motor; and replacing said electromagnetic switch with said relay module to disconnect said induction motor from said distribution panel and to mount said relay module to said distribution panel.

* * * * *